US011154871B2

(12) United States Patent
Whitman

(10) Patent No.: US 11,154,871 B2
(45) Date of Patent: Oct. 26, 2021

(54) SLUICE BOX MOUTH AND SIFTER PAN SYSTEM

(71) Applicant: Lucian D. Whitman, Lake Isabella, CA (US)

(72) Inventor: Lucian D. Whitman, Lake Isabella, CA (US)

( * ) Notice: Subject to any disclaimer, the term of this patent is extended or adjusted under 35 U.S.C. 154(b) by 112 days.

(21) Appl. No.: 16/654,163

(22) Filed: Oct. 16, 2019

(65) Prior Publication Data

US 2021/0114041 A1 Apr. 22, 2021

(51) Int. Cl.

| | |
|---|---|
| ***B03B 5/26*** | (2006.01) |
| ***B03B 11/00*** | (2006.01) |
| ***B03B 9/00*** | (2006.01) |
| ***B03B 5/40*** | (2006.01) |

(52) U.S. Cl.
CPC ..... *B03B 11/00* (2013.01); *B03B 5/40* (2013.01); *B03B 9/00* (2013.01)

(58) Field of Classification Search
CPC ..... B03B 11/00; B03B 5/40; B07B 1/185; B07B 1/4663; B07B 4/08; B07B 9/00; B07B 1/04
USPC ..... 209/17
See application file for complete search history.

(56) References Cited

U.S. PATENT DOCUMENTS

| | | | | |
|---|---|---|---|---|
| 1,973,770 | A * | 9/1934 | McCullough | B03B 5/02 209/14 |
| 2,328,436 | A | 8/1943 | Eickemeyer | |
| 4,289,241 | A | 9/1981 | Litrap | |
| 4,472,269 | A | 9/1984 | Swick | |
| 4,851,112 | A | 7/1989 | Schlensker | |
| 5,785,182 | A * | 7/1998 | Ashcraft | C22B 3/02 209/44 |
| D666,086 | S | 8/2012 | Mundhra | |
| 8,646,614 | B2 | 2/2014 | Peterson | |
| 8,678,192 | B1 | 3/2014 | Pung et al. | |
| 9,067,215 | B2 | 6/2015 | Moe | |
| 9,132,452 | B2 | 9/2015 | Trivette et al. | |
| 10,081,019 | B1 | 9/2018 | Whitman | |

FOREIGN PATENT DOCUMENTS

GB 4225 A 11/1907

OTHER PUBLICATIONS

"Best Sluice Box & Gold-Panning Kit Reviews (2019): The Gear We Recommend," Finding a Fortune website: https://www.findingafortune.net/best-sluice-box-gold-panning-kit/.

"ASR Outdoor Deluxe Sluice Box Gold Prospecting Kit Classifier Pan 16pc," Walmart website: https://www.walmart.com/ip/ASR-Outdoor-Deluxe-Sluice-Box-Gold-Prospecting-Kit-Classifier-Pan-16pc/863060703?wmlspartner=wlpa&selectedSellerId=1220&adid=2222222222782010052&wl0=g&wl1=g&wl2=c&wl3=340964014286&wl4=pla-669920149919&wl5=9008192&wl6=&wl7=&wl8=&wl9=pla&wl10=113500236&wl11=online&wl12=863060703&wl13=&veh=sem&gclid=CliBsbG81-ICFc7AyAodupEMgA.

* cited by examiner

*Primary Examiner* — Charles A Fox
*Assistant Examiner* — Molly K Devine
(74) *Attorney, Agent, or Firm* — Nath, Goldberg & Meyer; Richard C. Litman

(57) ABSTRACT

The sluice box mouth and sifter pan system includes a sluice box mouth and a plurality of stackable sifter pans. The sluice box mouth includes a substantially planar bottom plate with a first upright sidewall extending from a first edge of the plate and an opposing second upright sidewall extending from an opposing, second edge of the plate. One of the sifter pans can be removably positioned on the bottom plate. The first and second sidewalls each include an arcuate portion for engaging a peripheral wall of the pan and securing the pan to the sluice box mouth.

8 Claims, 7 Drawing Sheets

SLUICE BOX MOUTH AND SIFTER PAN SYSTEM

BACKGROUND

1. Field

The disclosure of the present patent application relates to mining implements, and particularly to a sluice box mouth and sifter pan system.

2. Description of the Related Art

The ability to separate solids from liquids and further group the separated solids based on size is useful in several industries, including mining or panning for gold. A sluice box is typically used for extracting ore and other desirable materials from running water. With conventional sluice boxes, a user is generally required to manually classify or sort out larger debris from a material using a sifting pan prior to delivering the classified material to the sluice box. This preparatory step is generally time-consuming for the user as the user's attention is required to handle the sifting pan.

Thus, a sluice box mouth and sifter pan system solving the aforementioned problems is desired.

SUMMARY

An embodiment of the present teachings relates to a sluice box mouth and sifter pan system including a sluice box mouth and one or more sifter pans. The sluice box mouth includes a substantially planar bottom plate with a first upright sidewall extending from a first edge of the plate and an opposing second upright sidewall extending from an opposing, second edge of the plate. The upright sidewalls of the sluice box mouth each include a connecting portion, an arcuate portion, and a flared portion. The connecting portion is configured for detachable connection to a respective sidewall of a sluice box. The flared portions define a progressively widening space therebetween. A sifter pan can be removably disposed on the bottom plate such that the arcuate portions engage a peripheral wall of the sifter pan, thereby securing the sifter pan to the sluice box mouth. One or more additional sifter pans can be stacked on the sifter pan disposed on the bottom plate.

An embodiment of the present teachings relates to a sluice box. The sluice box includes a substantially planar bottom plate with a first upright sidewall extending from a first edge of the plate and an opposing second upright sidewall extending from an opposing, second edge of the plate. The upright sidewalls of the sluice box include opposing linear, arcuate, and flared portions. The linear portions of the upright sidewalls extend parallel to each other, while the flared portions define a progressively widening space therebetween. The bottom plate includes a grooved portion extending between the linear portions. A sifter pan can be removably disposed on the bottom plate such that the arcuate portions engage a peripheral wall of the sifter pan, thereby securing the sifter pan to the sluice box mouth. One or more additional sifter pans can be stacked on the sifter pan disposed on the bottom plate. A sluice box system can include the sluice box and one or more sifter pans.

A user may unload a material to be sorted with water (or other liquid) into a sifter pan disposed on the bottom plate. Smaller particles can pass through the filtering mesh for further processing in the sluice box.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
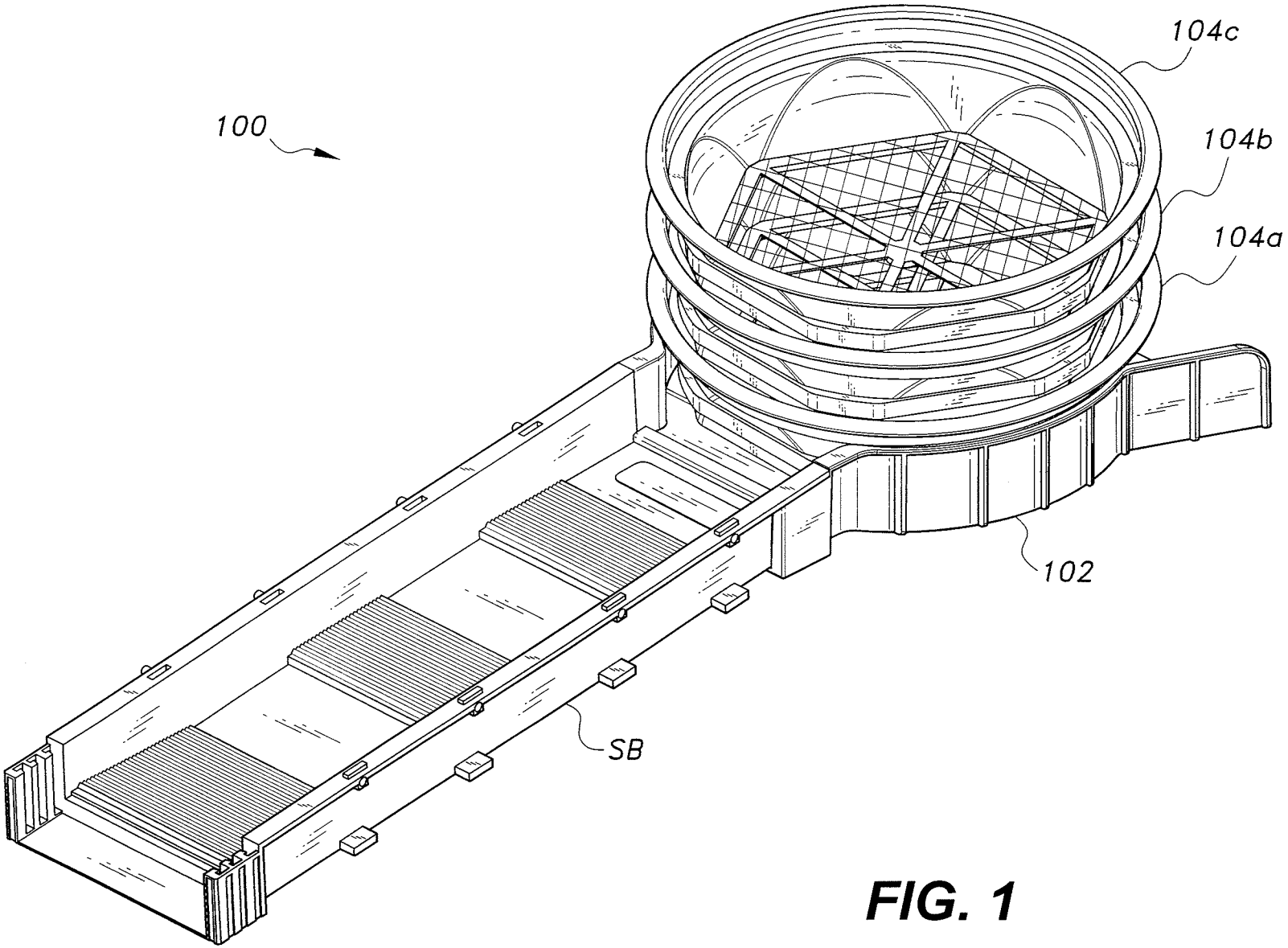
FIG. 1 is an environmental, perspective view of a sluice box mouth with a plurality of sifter pans, the sluice box mouth is shown attached to a sluice box.
Figure 2:
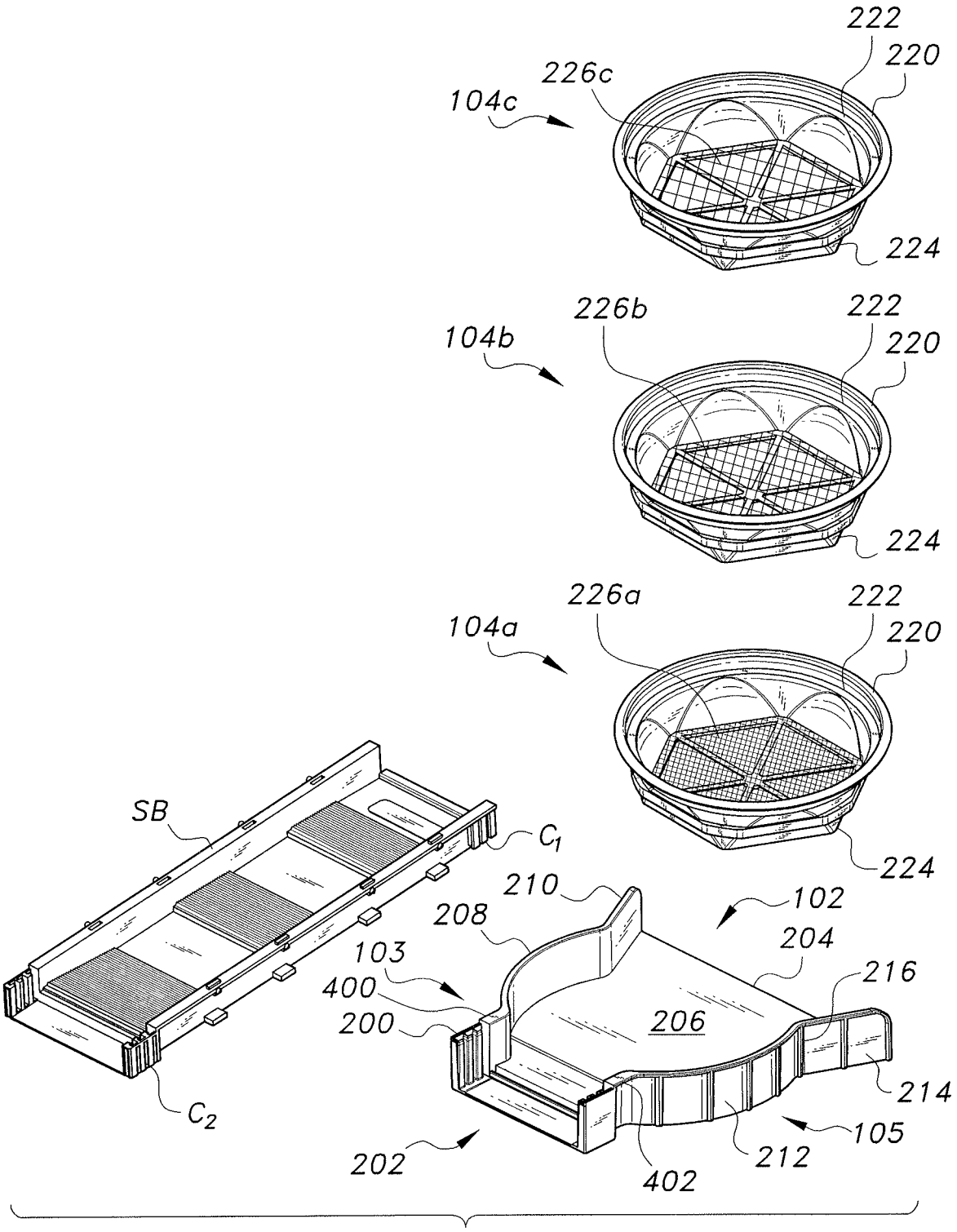
FIG. 2 is an exploded, perspective view of the sluice box mouth, sifter pans and sluice box of FIG. 1.

A sluice box mouth and sifter pan system 100 is shown connected to a sluice box SB in FIG. 1, and in an exploded view in FIG. 2. The sluice box mouth and sifter pan system 100 can include a sluice box mouth 102 and a plurality of stackable sifter pans 104*a*, 104*b*, 104*c*, as shown. The sifter pan 104*a* can be removably held within the sluice box mouth 102, as described in further detail below. While three sifter pans 104*a*, 104*b*, 104*c* are illustrated, it should be understood that one or any number of sifter pans can be used in the system, depending on the number of levels of filtration desired.

Figure 3:
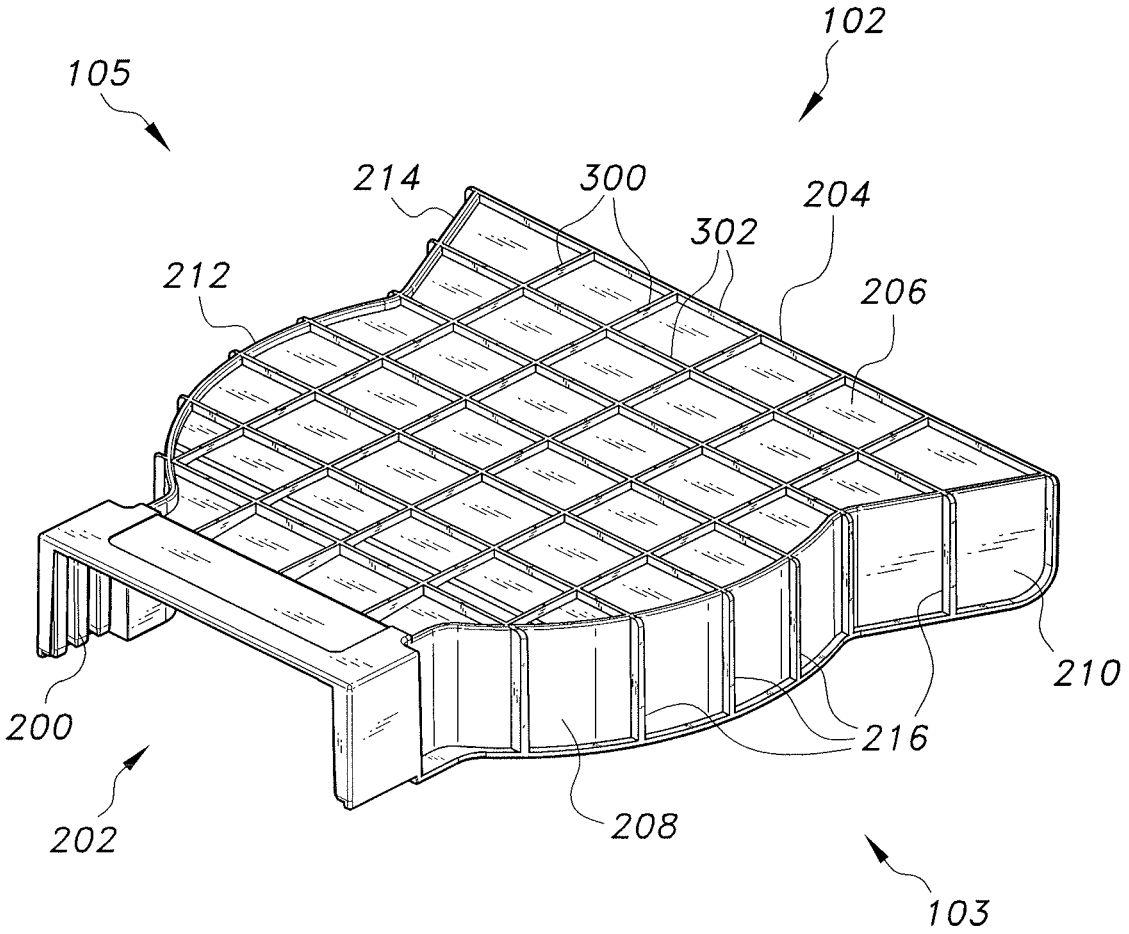
FIG. 3 is a perspective, bottom view of the sluice box mouth of FIG. 1.
Figure 4:
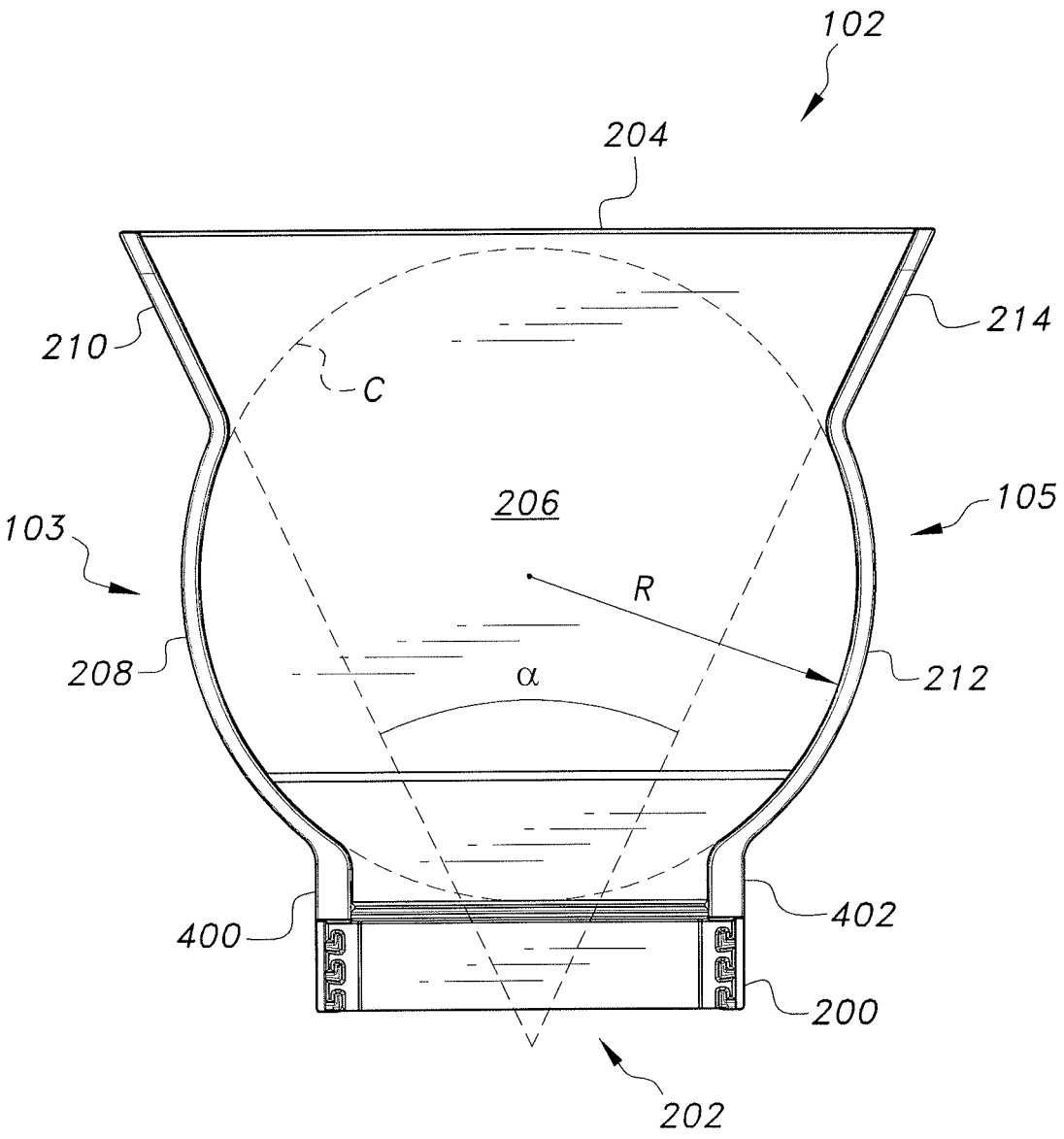
FIG. 4 is a top view of the sluice box mouth of FIG. 1.

An embodiment of the present teachings relates to a sluice box mouth, as shown in FIGS. 2-4. The sluice box mouth 102 includes an open input end 204 and an opposing open output end 202. The sluice box mouth 102 includes a substantially planar bottom plate 206 with a first upright sidewall 103 extending from a first edge of the plate and an opposing second upright sidewall 105 extending from an opposing, second edge of the plate. The first upright sidewall 103 includes a first end portion 400 proximate the output end 202, a second end portion 210 proximate the input end 204, and an arcuate portion 208 between the first end portion 400 and the second end portion 210. Similarly, the second upright sidewall 105 includes a first end portion 402 proximate the output end 202, a second end portion 214 proximate the input end 204, and an arcuate portion 212 between the first end portion 402 and the second end portion 214. The first end portion 402 and the first end portion 400 are parallel and opposed to one another. The second end portion 210 and the second end portion 214 are opposed to one another and angled from each other such that they have a progressively widening space therebetween. In an embodiment, the sluice box mouth 102 includes a connector 200 at each of the first end portions 400, 402. In an embodiment, the connector 200 is designed and configured to connect to a mating connector C1 on a sluice box SB, as shown and described in U.S. Pat. No. 10,081,019 B1, incorporated herein by reference in its entirety. For example, connector 200 can include vertically extending rails and recesses for slidably engaging the mating connector C1. Alternatively, the end portions 400, 402 may include another type of connector suitable for connecting to a sluice box or mining equipment, or may simply be configured as two parallel sidewall sections without a connecting structure.

As best seen in FIGS. 2-3, a plurality of parallel, vertical support ribs 216 can be disposed at intervals along outer surfaces of both the first and second sidewalls 103, 105. As best seen in FIG. 3, an outer surface of the bottom plate 206 of the sluice box mouth 102 is reinforced by a plurality of longitudinal, reinforcing support ribs 300 that extend from the output end 202 to the input end 204 and a plurality of lateral reinforcing support ribs 302 that extend between the first upright sidewall 103 to the second upright sidewall 105 and intersect the longitudinal support ribs 300.

The various structural relationships of the first upright sidewall 103 and the second upright sidewall 105 are best seen in FIG. 4. The first end portion 400 extends parallel to the second end portion 402. The arcuate portions 208, 212 can define opposing arc portions of a common circle C, having a radius R.

An embodiment of the present teachings relates to a sluice box mouth and sifter pan system 100 including the sluice box mouth 102 and a plurality of stackable sifter pans 104*a*, 104*b*, 104*c*, as shown. The sluice box mouth 102 is shown connected to a sluice box SB in FIG. 1, and in an exploded view in FIG. 2. The radius R can be slightly larger than a radius of sifter pans 104*a*, 104*b*, 104*c* in order to receive one or more of the sifter pans 104*a*, 104*b*, 104*c*. Preferably, the arcuate portions 208, 212 engage the sifter pans 104*a*, 104*b*, and 104*c* in a friction fit. The second end portion 210 and the second end portion 214 are spaced from each other at an angle $\alpha$. The angle $\alpha$ is shown as an acute angle, however, the specific angle can be selected depending on the particular application parameters, such as the volume of fluid flow through the sluice box mouth 102.

Figure 5:
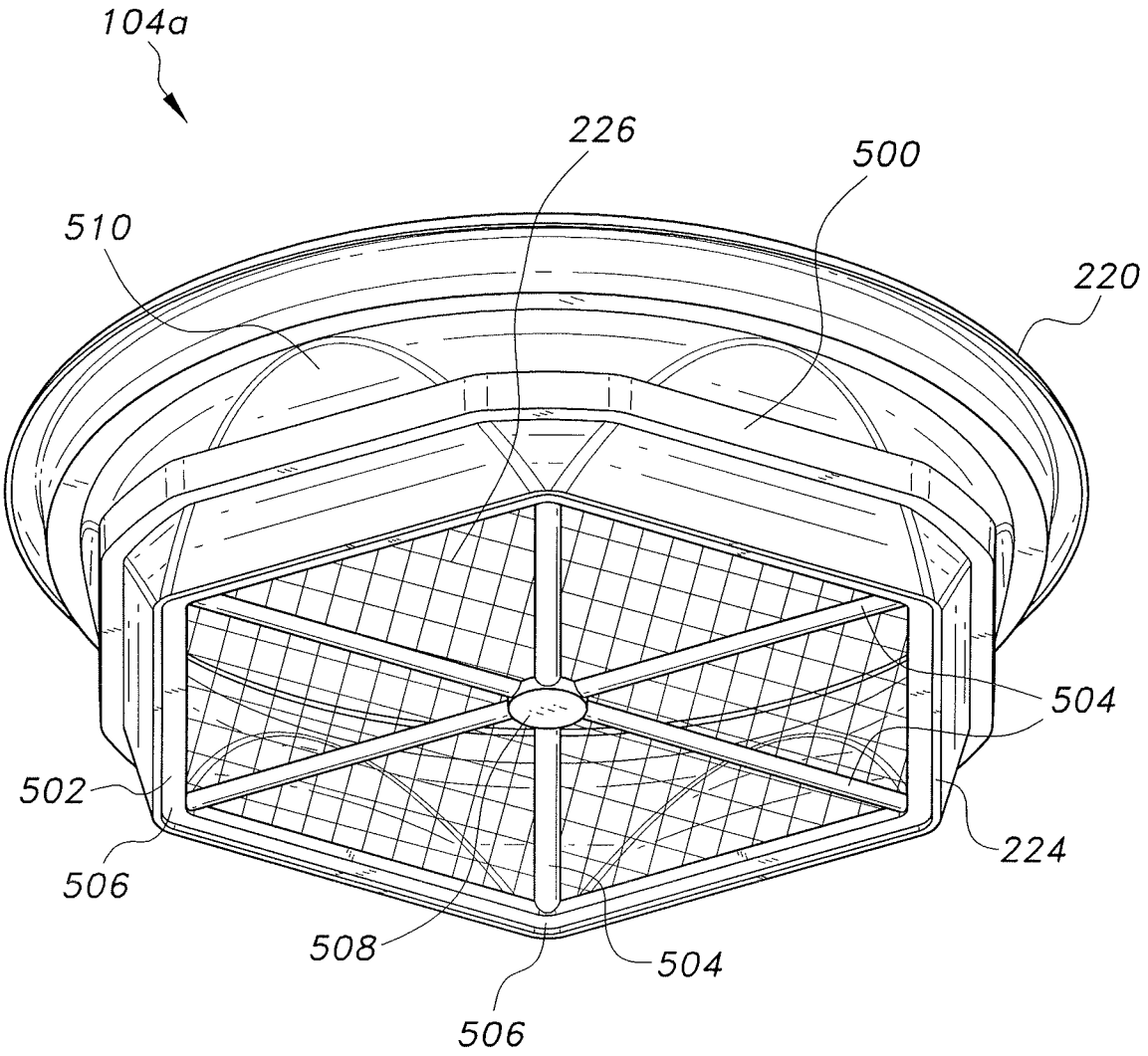
FIG. 5 is a perspective, bottom view of one of the sifter pans of FIG. 1.
Figure 6:
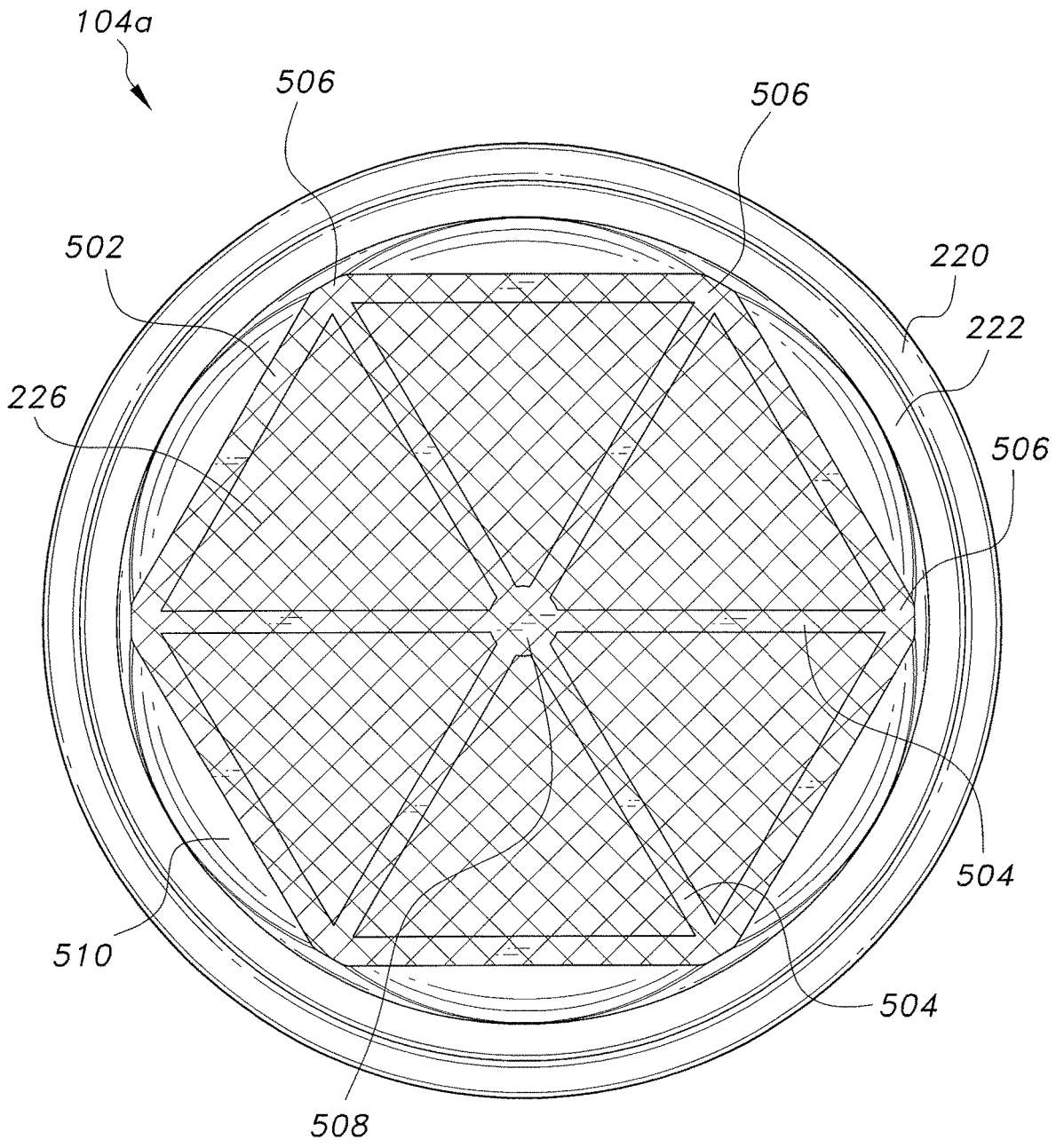
FIG. 6 is a top view of the sifter pan of FIG. 5.

Details of the sifter pans 104*a*, 104*b*, and 104*c* are shown in FIG. 2 and FIGS. 5-6. Sifter pans 104*b* and 104*c* may have the same configuration as the sifter pan 104*a* shown in FIGS. 5-6. The sifter pan 104*a* includes a horizontal bottom support 224, a circular upper rim 220, and a peripheral side wall 510 extending between the upper rim 220 and the bottom support 224. The peripheral side wall 510 can have a tapering diameter wherein the diameter of the peripheral side wall 510 is largest at the upper rim 220 and becomes increasingly smaller as it approaches the bottom support 224. The peripheral side wall 510 includes an upper ledge 222 that protrudes from an outer surface of the side wall 510. As best seen in FIG. 5, each sifter pan 104*a*, 104*b*, and 104*c* includes an outwardly extending, substantially hexagonal collar 500 spaced from the ledge 222. When multiple sifter pans 104*a*, 104*b*, and 104*c* are stacked one above the other as shown in FIG. 1, the collar 500 of the upper sifter pan rests upon the upper ledge 222 of the lower sifter pan and thereby spaces the bottom supports 224 of the sifter pans from each other. The bottom support 224 includes a base 502 extending normal to the peripheral side wall 510. The base 502 includes a frame with a central opening. A plurality of ribs 504 extend across the opening from corners 506 of the base 502 and intersect at a central, connecting hub 508. The bottoms of the ribs can be rounded, while the top of the ribs 504 can be planar to support a filtering mesh 226 thereon. In an embodiment, both the frame and the filtering mesh 226 is hexagonal or substantially hexagonal. The mesh 226 can be positioned on the base 502, the ribs 504 and the central hub 508.

As shown in FIG. 2, multiple sifter pans 104*a*, 104*b*, 104*c* can be stacked one upon the other. In an embodiment, the top sifter pan 104*c* can have the most course filtering mesh 226*c*, the middle sifter pan 104*b* can have a finer filtering mesh 226*b*, and the lower sifter pan 104*a* can have the finest filtering mesh 226*a*. In this configuration, the largest particles can be retained in the top sifter pan 104*c*, the medium sized particles can be retained in the middle sifter pan 104*b*, and the finer particles can be retained in the lower sifter pan 104*a*. The finest particles that pass through the finest filtering mesh 226*a* can be released onto the bottom plate 206 of the sluice box mouth 102 where they can then proceed to move through the output end 202 of the sluice box mouth 102, and into any connected sluice box SB. The substantially hexagonal shape of the filtering meshes 226*a*, 226*b*, 226*c* can allow the filtering meshes to be cut from a sheet of filtering mesh material with minimal waste of mesh material, as opposed to sifter pans with circular mesh. It should be noted that the term "substantially hexagonal" as used herein is meant to include hexagonal shapes with rounded or flattened corners, as best seen in FIG. 6.

In use, the sluice box mouth and sifter pan system 100 may be configured as shown in FIG. 1. A user may unload a material to be sorted with water (or other liquid) into the top sifter pan 104*c*. The water can facilitate passing the smaller particles through the filtering meshes 226*a*, 226*b*, 226*c*. Additionally, water may be fed into the input end 204 of the sluice box mouth 102 to wash the finest particles into the sluice box SB for further processing and collection. As shown in FIG. 2, the arcuate portions 208, 212 of the upright sidewalls 103, 105 are sized to allow the sifter pan 104*a* to be firmly retained therebetween.

Figure 7:
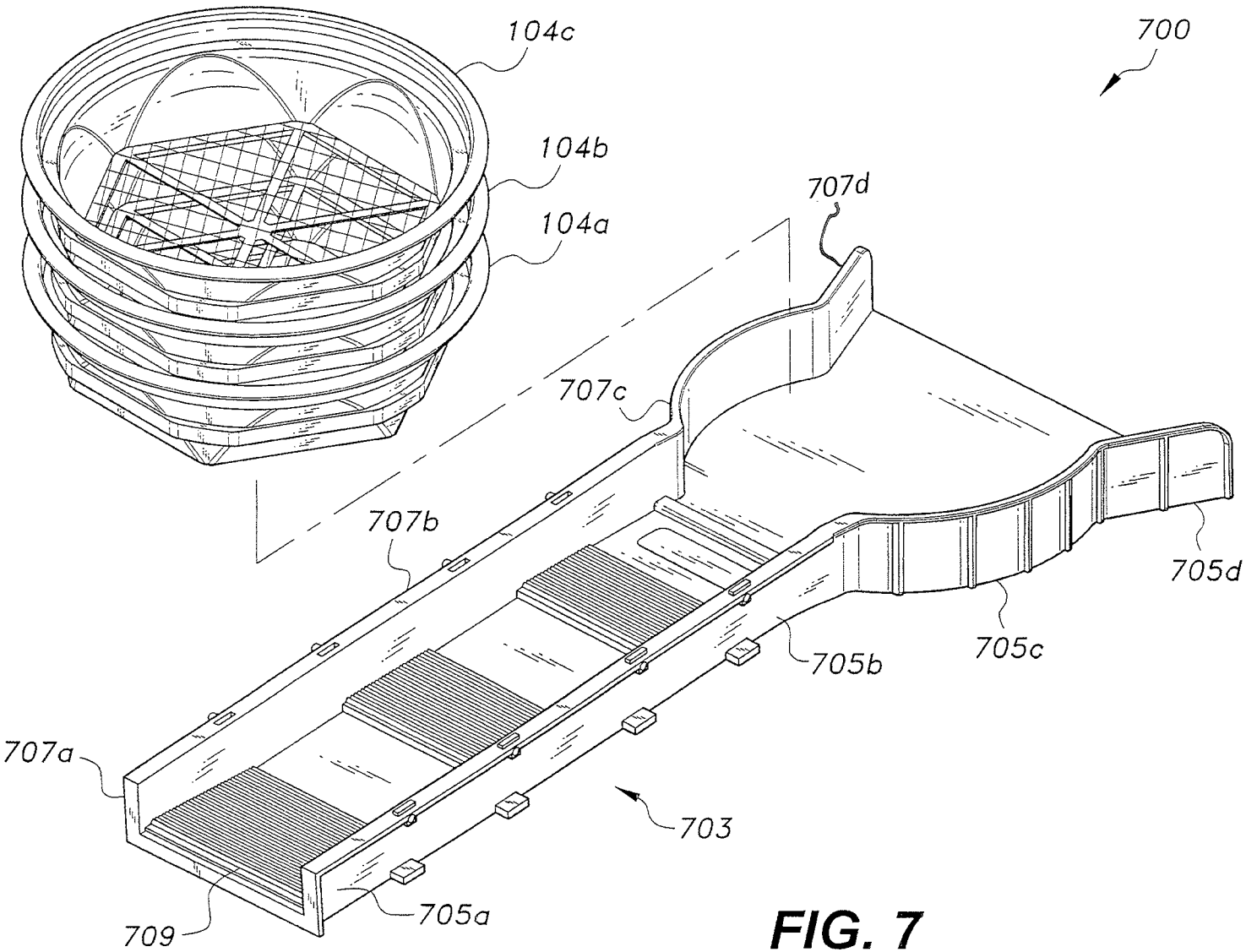
FIG. 7 is a perspective view of a sluice box system including a sluice box and sifter pans.

An embodiment of the present teachings relates to a sluice box 703, as shown in FIG. 7. The sluice box 703 includes a substantially planar bottom plate 709 with a first upright sidewall 705*a* extending from a first edge of the plate 709 and an opposing second upright sidewall extending from an opposing, second edge of the plate. The upright sidewall 705*a* includes linear, arcuate, and flared portions 705*b*, 705*c*, and 705*d*, respectively. The upright sidewall 707*a* includes linear, arcuate, and flared portions 707*b*, 707*c*, and 707*d*, respectively. The linear portion 705*b* opposes and extends parallel to linear portion 707*b*. The bottom plate 709 includes a grooved, rectangular portion extending between linear portions 705*b* and 707*b*. The flared portions 705*d* and 707*d* define a progressively widening space therebetween.

An embodiment of the present teachings relates to a sluice box system, designated 700 in FIG. 7. The sluice box system 700 includes the sluice box 703 and one or more sifter pans. The sifter pans can be the same as sifter pans 104*a*-104*c*, described previously. Sifter pan 104*a* can be removably disposed on the bottom plate such that the arcuate portions 705*c* and 707*c* engage a peripheral wall of the sifter pan, thereby securing the sifter pan to the sluice box mouth. One or more additional sifter pans can be stacked on the sifter pan disposed on the bottom plate.

It should be noted that the sifter pans 104*a*, 104*b*, 104*c* can be utilized separately from the sluice box, as they can be used alone or with a standard sized 5 gallon bucket. The sifter pans 104*a*, 104*b*, and 104*c* are preferably sized such that the outwardly extending upper rim 220 can rest on the upper rim of the bucket.

It is to be understood that the sluice box mouth and sifter pan system is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A sluice box mouth, comprising:

an open input end;

an open output end opposing the input end;

a substantially planar bottom plate extending from the input end to the output end;

a first upright sidewall extending along a first edge of the bottom plate, the first upright sidewall having a first end portion proximate the output end, a second end portion proximate the input end, and a first arcuate portion between the first end portion and the second end portion; and a second upright sidewall extending along a second edge of the bottom plate opposing the first edge, the second upright sidewall having a first end portion proximate the output end, a second end portion proximate the input end, and a second arcuate portion between the first end portion and the second end portion, wherein the first end portion of the first sidewall is parallel to the first end portion of the second sidewall, further wherein the second end portion of the first sidewall and the second end portion of the second sidewall are spaced at an acute angle from each other, thereby defining a progressively widening space therebetween.

2. The sluice box mouth according to claim 1, wherein the vertex of the acute angle lies within the first and second end portions of the first and second sidewalls.

3. A sifter pan comprising:

a horizontal bottom support including a substantially horizontal base and a filtering mesh on the base, the base including a substantially hexagonal frame, a central opening within the frame, and a plurality of intersecting ribs extending from respective corners of the frame across the central opening;

a circular upper rim; and a peripheral side wall extending between the bottom support and the upper rim, wherein an outer surface of the peripheral wall includes a substantially hexagonal collar and a circular upper ledge spaced from the hexagonal collar.

4. A sluice box system, comprising:

a sluice box and sluice box mouth system comprising:

the sluice box having a bottom plate and first and second upright sidewalls extending from opposing edges of the bottom plate;

the sluice box mouth having sidewalls, the sidewalls configured to have a sequential linear portion, an arcuate portion, and a flared portion, wherein the flared portions of the sidewalls define a progressively widening space therebetween, the linear portion of the sidewalls are parallel, the arcuate portions being disposed between the linear portions and the flared portions, and the bottom plate includes a grooved portion extending between the linear portions; and at least one sifter pan, the at least one sifter pan comprising:

a first sifter pan, the first sifter pan including a horizontal bottom support, a circular upper rim, and a peripheral side wall extending between the bottom support and the upper rim, the horizontal bottom support including a base and a filtering mesh, the mesh being disposed on the base, wherein the bottom plate is configured to removably receive the first sifter pan, and wherein the arcuate portions of the first and second upright sidewalls are configured and dimensioned to engage the peripheral side wall of the sifter pan.

5. The sluice box system according to claim 4, further comprising one or more additional sifter pans, the one or more additional sifter pans being stackable on the first sifter pan to provide a stacked configuration of sifter pans.

6. The sluice box system according to claim 5, wherein each of the sifter pans each has a substantially hexagonal collar and a circular upper ledge extending from the peripheral wall, wherein the collar of one sifter pan is positioned upon the circular upper ledge of an adjacent sifter pan in the stacked configuration.

7. The sluice box system according to claim 4, wherein the flared portion of the sidewalls, which define the progressively widening space, are spaced at an acute angle from each other.

8. The sluice box system according to claim 7, wherein the vertex of the acute angle lies within the linear portions of the sidewalls.

* * * * *